US009532157B2

(12) United States Patent
Rämö et al.

(10) Patent No.: US 9,532,157 B2
(45) Date of Patent: Dec. 27, 2016

(54) AUDIO PROCESSING FOR MONO SIGNALS

(75) Inventors: Anssi Sakari Rämö, Tampere (FI); Adriana Vasilache, Tampere (FI); Lasse Juhani Laaksonen, Nokia (FI); Miikka Tapani Vilermo, Siuro (FI)

(73) Assignee: Nokia Technologies Oy, Espoo (FI)

( * ) Notice: Subject to any disclaimer, the term of this patent is extended or adjusted under 35 U.S.C. 154(b) by 258 days.

(21) Appl. No.: 14/366,522

(22) PCT Filed: Dec. 23, 2011

(86) PCT No.: PCT/IB2011/055934

§ 371 (c)(1),
(2), (4) Date: Jun. 18, 2014

(87) PCT Pub. No.: WO2013/093569

PCT Pub. Date: Jun. 27, 2013

(65) Prior Publication Data

US 2015/0124972 A1 May 7, 2015

(51) Int. Cl.

| | |
|---|---|
| ***H04R 5/00*** | (2006.01) |
| ***H04S 5/00*** | (2006.01) |
| ***G10L 19/008*** | (2013.01) |
| ***H04R 3/00*** | (2006.01) |
| *G10L 21/0208* | (2013.01) |
| *G10L 21/0272* | (2013.01) |

(52) U.S. Cl.

CPC ..... *H04S 5/00* (2013.01); *G10L 19/008* (2013.01); *H04R 3/00* (2013.01); *G10L 21/0208* (2013.01); *G10L 21/0272* (2013.01); *H04R 2227/009* (2013.01); *H04R 2499/11* (2013.01)

(58) Field of Classification Search

CPC . H04R 3/00; H04R 2499/11; H04R 2227/009; H04S 5/00; G10L 19/008; G10L 21/0208; G10L 21/0272

USPC ..... 381/17

See application file for complete search history.

(56) References Cited

U.S. PATENT DOCUMENTS

| | | | | |
|---|---|---|---|---|
| 2006/0053002 | A1 | 3/2006 | Visser et al. | |
| 2009/0164212 | A1* | 6/2009 | Chan | G10L 21/0208 704/226 |
| 2010/0030563 | A1 | 2/2010 | Uhle et al. | |

OTHER PUBLICATIONS

International Search Report and Written Opinion received for corresponding Patent Cooperation Treaty Application No. PCT/IB2011/055934, dated Dec. 18, 2012, 11 pages.

International Search Report received for corresponding Patent Cooperation Treaty Application No. PCT/IB2011/055934 , dated Dec. 10, 2012, 4 pages.

* cited by examiner

*Primary Examiner* — Paul S Kim

(74) *Attorney, Agent, or Firm* — Alston & Bird LLP

(57) ABSTRACT

It is inter alia disclosed to generate a signal representation at least based on a noise reduced component from a signal and on a noise component from the signal, said signal representation comprising at least two channel representations.

20 Claims, 4 Drawing Sheets

AUDIO PROCESSING FOR MONO SIGNALS

RELATED APPLICATION

This application was originally filed as PCT Application No. PCT/IB2011/055934 filed Dec. 23, 2011.

FIELD

Embodiments of this invention relate to generating a multi-channel signal representation, in particular for speech, audio and video signal.

BACKGROUND

There is current development in voice communications to move towards higher voice quality. There are two main dimensions how to achieve this: Increase the signal bandwidth from narrowband to wideband and to superwideband and ultimately to full bandwidth, and the other dimension is to add spatial audio in the form of stereo, binaural stereo or multi-channel playback.

In order to capture true spatial audio at least two microphones and preferable more are needed to capture, process and finally render realistic sounding field. However, low cost devices may only have a single microphone and adding more is cost prohibitive.

SUMMARY OF SOME EMBODIMENTS OF THE INVENTION

Thus, a cost reduced approach for generating a multi-channel signal is desirable, for instance with respect to application of speech, audio or video signals.

According to a first aspect of the invention, a method is disclosed, comprising generating a signal representation at least based on a noise reduced component from a signal and on a noise component from the signal, said signal representation comprising at least two channel representations.

According to a second aspect of the invention, an apparatus is disclosed, which is configured to perform the method according to the first aspect of the invention, or which comprises means for performing the method according to the first aspect of the invention, i.e. means for generating a signal representation at least based on a noise reduced component from a signal and on a noise component from the signal, said signal representation comprising at least two channel representations.

According to a third aspect of the invention, an apparatus is disclosed, comprising at least one processor and at least one memory including computer program code for one or more programs, the at least one memory and the computer program code configured to, with the at least one processor, cause the apparatus at least to perform the method according to the first aspect of the invention. The computer program code included in the memory may for instance at least partially represent software and/or firmware for the processor. Non-limiting examples of the memory are a Random-Access Memory (RAM) or a Read-Only Memory (ROM) that is accessible by the processor.

According to a fourth aspect of the invention, a computer program is disclosed, comprising program code for performing the method according to the first aspect of the invention when the computer program is executed on a processor. The computer program may for instance be distributable via a network, such as for instance the Internet. The computer program may for instance be storable or encodable in a computer-readable medium. The computer program may for instance at least partially represent software and/or firmware of the processor.

According to a fifth aspect of the invention, a computer-readable medium is disclosed, having a computer program according to the fourth aspect of the invention stored thereon. The computer-readable medium may for instance be embodied as an electric, magnetic, electro-magnetic, optic or other storage medium, and may either be a removable medium or a medium that is fixedly installed in an apparatus or device. Non-limiting examples of such a computer-readable medium are a RAM or ROM. The computer-readable medium may for instance be a tangible medium, for instance a tangible storage medium. A computer-readable medium is understood to be readable by a computer, such as for instance a processor.

According to a sixth aspect of the invention, a computer program product is disclosed, comprising at least one computer readable non-transitory memory medium having program code stored thereon, the program code which when executed by an apparatus cause the apparatus at least to generate a signal representation at least based on a noise reduced component from a signal and on a noise component from the signal, said signal representation comprising at least two channel representations.

According to a seventh aspect of the invention, a computer program product is disclosed, comprising one ore more sequences of one or more instructions which, when executed by one or more processors, cause an apparatus at least to generate a signal representation at least based on a noise reduced component from a signal and on a noise component from the signal, said signal representation comprising at least two channel representations.

In the following, features and embodiments pertaining to all of these above-described aspects of the invention will be briefly summarized.

A signal representation is generated at least based on a noise reduced component from a signal and based on a noise component from the signal, said signal representation comprising at least two channel representations. The signal may be denoted as original signal in the sequel.

For instance, said original signal may represent a speech, audio or video signal. Furthermore, as an example, said original signal may represent a mono signal which may be generated by a single signal source configured to record/or capture an audio or video signal from the environment, e.g. like a single (mono) microphone or a single (mono) video camera or any other well-suited single signal source.

For instance, the signal representation comprising said at least two channel representations may represent a kind of spatial signal representation. As an example, said spatial signal representation may be a kind of stereo, binaural stereo or another multi-channel playback signal representation, wherein said at least two channel representations may form said spatial signal representation.

It has to be understood that a multi-channel signal represents any representation comprising or being associated with at least two channel representation.

For instance, at least two of the at least two channel representations may differ at least partially from each other and/or at least two of the at least two channel representations may be substantially the same or may be equal.

Said at least two channel representations are generated based on a noise reduced component from the original signal and on a noise component from the original signal.

The noise reduced component may be a component representing the main information content of the signal and the noise component may be a component representing the noise or a part of the noise of the signal. As an example, the noise component and the noise reduced component may represent at least partially decorrelated components. For instance, the noise component may be considered to represent a separate channel containing mainly spatial signal field.

The noise reduced component may for instance at least mostly represent the main information component of the signal. For instance, under the non-limiting example that the signal represents a speech signal, the main information may represent the speech information in the signal and the noise component may represent a background noise in the signal.

For instance, the noise component may be considered to represent a spatial signal information which can be used for generating said signal representation comprising said at least two channel representations.

As an example, the noise component may be at least partially combined with the noise reduce component and/or at least partially combined with the original signal in order to generate at least one channel representative of the at least two channel representatives in accordance with a respective combination rule.

The combining may comprise any suited mathematical function, for instance at least one of addition, subtraction, filtering, mixing or weighting.

Thus, as an example, generating the signal representation comprising said at least two channel representatives based on the noise reduced component and on the noise component may be performed in such a way that the noise component may be used to introduce a spatial effect on the at least two channel representatives by means of combining the noise component with the noise reduced component and/or the original signal in accordance with a combination rule in order to obtain at least one of the at least two channel representatives. For instance, this combination rule may be part or may represent a signal matrix processing rule.

Accordingly, the noise reduced component, the noise component and (optionally) the original signal may be combined to at least one channel representative in order to produce a spatial signal representation in accordance with a combination rule, wherein said combining may comprise any suited mathematical function, for instance at least one of addition, subtraction, filtering, mixing or weighting, as mentioned above.

According to an exemplary embodiment of all aspects of the invention, the signal represents a mono signal.

For instance, this mono signal may be generated by a single signal source configured to record/or capture an audio or video signal from the environment, e.g. like a single (mono) microphone or a single (mono) video camera or any other well-suited single signal source.

According to an exemplary embodiment of all aspects of the invention, the signal representation is a spatial signal representation.

For instance, under the non-limiting assumption that the signal represents a speech or audio signal, the spatial signal representation may be stereo, binaural or any other multi-channel representation which is generated based on the noise reduced component and on the noise component of the original signal.

According to an exemplary embodiment of all aspects of the invention, at least one of the at least two channel representations is generated based on a combination of the noise reduced component and the noise component in accordance with a combination rule.

Any of the above mentioned combination rules may be applied for this combination.

For instance, as a non-limiting example, said combination rule for generating an ith channel representation $c_i$ may combine the noise reduced component, denoted as nrc, and the noise component, denoted as nc, in the following way:

$$c_i = w_{nrc,i} * nrc + w_{nc,i} * nc, \tag{1}$$

wherein $w_{nrc,i}$ and/or $w_{nc,i}$ may represent optional weighting factors.

As an example, in case said signal representation represents a stereo signal representation, wherein said at least two channel representations comprises a first channel representation associated with a left channel and a second channel representation associated with a right channel, the first channel representation may be generated based on a combination of the noise reduced component and the noise component in accordance with a first combination rule and the second channel representation may be generated based on a combination of the noise reduced component and the noise component in accordance with a second combination rule, wherein the first and second combination rule may for instance differ from each other at least partially.

For instance, as an example of the first combination rule, the noise component, denoted as nc, may be added to the noise reduced component, denoted as nrc, in order to generate the first channel representative, denoted as $c_1$, which may be expressed as follows:

$$c_1 = w_{nrc,1} * nrc + nc. \tag{2}$$

Furthermore, for instance, as an example of the second combination rule, the noise component may be subtracted from the noise reduced component in order to generate the second channel representative, denoted as $c_2$, which may be expressed as follows:

$$c_2 = w_{nrc,2} * nrc - nc. \tag{3}$$

For instance, the optional weighting factors $w_{nrc,1}$ and/or $w_{nrc,1}$ may be used to shift the main information to a desired channel of the left of right channel by means of setting the optional weighting factor associated with the desired channel to a higher value than the weighting factor associated with the other channel.

As an example, the weighting factor $w_{nrc,1}$ may be set to $w_{nrc,1}=1$ and the weighting factor $w_{nrc,2}$ may be set to $w_{nrc,2}>w_{nrc,1}$, e.g. to w2=1.5, wherein this may result that the main information is slightly panned to the right channel with background coming from an ambivalent direction. Any other well-suited weighting factors may be used. For instance, $w_{nrc,2}=w_{nrc,1}$ may be used to shift the main information in the middle.

According to an exemplary embodiment of all aspects of the invention, at least one of the at least two channel representations is based on a combination of the noise reduced component, the noise component and the signal in accordance with a combination rule.

Any of the above mentioned combination rules may be applied for this combination.

For instance, as a non-limiting example, said combination rule for generating an ith channel representation may combine the noise reduced component, denoted as nrc, the noise component, denoted as nc, and the original signal, denoted as s to channel representation c in the following way:

$$c_i = w_{nrc,i} * nrc + w_{nc,i} * nc + w_{s,i} * s, \tag{4}$$

wherein $w_{nrc,i}$, $w_{nc,i}$ and/or $w_{s,i}$ may represent optional weighting factors.

As an example, this combination rule may be used as a basis for generating a binaural signal representation comprising a first channel representation $c_1$ associated with a left channel and comprising a second channel representation associated with a right channel $c_2$, which may be expressed as follows:

$$c_1=w_{nrc,1}*nrc+w_{nc,1}*nc+w_{s,1}*s, \text{ and} \quad (5)$$

$$c_2=w_{nrc,2}*nrc+w_{nc,2}*nc+w_{s,2}*s. \quad (6)$$

For instance, the weighting factors might be chosen that $c_1=c_2$ holds. In this example, a summed up output signal may be a mono representation. As a non-limiting example, $w_{nrc,1}=w_{nc,1}=w_{nc,2}=w_{nrc,1}=1$ may hold, and $w_{s,1}=w_{s,2}<1$ may hold, wherein $w_{s,1}=w_{s,2}=0.5$ may hold. Thus, the main information may be positioned in the middle and the background noise may come from the middle.

As another example, the weighting factors might be chosen that c1 and c2 differ from each other. For instance, if it is desired that the background noise shall come from an ambivalent direction, the weighting factors $w_{nc,1}$, and $w_{nc,2}$ may differ from each other, e.g. $w_{nc,1}=-w_{nc,2}$ may hold. For instance, $w_{nc,1}=1$ and $w_{nc,2}=-1$ (or vice versa) may hold.

As an example, the weighting factors may be chosen different from this example in order to obtain another well-suited adjustment of the main information and the background noise. For instance, the weighting factors may be chosen that the main information is shifted to a desired channel of the left or right channel.

According to an exemplary embodiment of all aspects of the invention, the signal representation comprises first channel representation based on a combination of the noise reduced component and the noise component in accordance with a first combination rule and a second channel representation based on a combination of the noise reduced component and the noise component in accordance with a second combination rule.

For instance, this signal representation may represent a stereo or binaural signal representation. As an example, the first combination rule might be based on equation (1) or (4) and the second combination rule might be based on equation (1) or (4).

According to an exemplary embodiment of all aspects of the invention, at least one of the at least two channel representations is a representation of the noise reduced signal.

For instance, an ith channel representation may be represented by the noise reduced component, denoted as nrc, weighted with a respective weighting factor:

$$c_i=w_{nrc,i}*nrc. \quad (7)$$

According to an exemplary embodiment of all aspects of the invention, at least one of the at least two channel representations is a representation of the original signal.

For instance, an ith channel representation may be represented by the original signal, denoted as s, weighted with a respective weighting factor:

$$c_i=w_{s,i}*s. \quad (8)$$

As an example, said at least two channel representations may represent at least three channel representations, wherein a first channel representation may be associated with a left channel, a second channel representation may be associated with a right channel and a third channel representation may be associated with a middle channel. Thus, said signal representation may be a surround signal representation.

As an example, the middle channel may be a representation of the noise reduced component or may be a representation of the original signal.

Furthermore, for instance, the first channel representation may be generated based on a combination of the noise reduced component, the noise component and the original signal in accordance with a first combination rule or based on a combination of the noise the noise reduced component and the noise component in accordance with a first combination rule, as mentioned above, and for instance, the second channel representation may be generated based on a combination of the noise reduced component, the noise component and the original signal in accordance with a first combination rule or based on a combination of the noise the noise reduced component and the noise component in accordance with a second combination rule, as mentioned above.

According to an exemplary embodiment of all aspects of the invention, a further channel representation of the at least two channel representations may be low-frequency representation generated based on a high pass filtered original signal or on a high pass filtered noise reduced signal.

For instance, this low frequency representative may be a bass signal representative which might used for a subwoofer or any other bass loadspeaker.

For instance, said surround signal representation may be a 3.1, 5.1, 7.1, 9.1 or any other surround signal representation, wherein the "1" in the x.i representation may be represented by the further channel representation and x may represent an odd number of channel representations.

According to an exemplary embodiment of all aspects of the invention, at least one of the at least two channel representations is a representation of the noise component.

For instance, an ith channel representation may be represented by the noise component 320, denoted as nc, weighted with a respective weighting factor:

$$c_i=w_{nc,i}*nc. \quad (9)$$

As an example, if it is desired that the background noise shall come from an ambivalent direction, the weighting factors $w_{nc,1}$, and $w_{nc,2}$ of two channel representations may be chosen in a way that these weighting factors differ from each other, e.g. $w_{nc,1}=-w_{nc,2}$ may hold. For instance, $w_{nc,1}=1$ and $w_{nc,2}=-1$ (or vice versa) may hold.

According to an exemplary embodiment of all aspects of the invention, the signal representation comprises a third channel representation being a first representation of the noise component and a fourth channel representation being a second representation of the noise component.

As a non-limiting example, said third channel representation c3 and said fourth channel representation c4 may be generated as follows:

$$c_3=w_{nc,3}*nc, \quad (10)$$

$$c_4=w_{nc,4}*nc. \quad (11)$$

Furthermore, as an example, the third channel representative $c_3$ and the fourth channel representative $c_5$ may be associated with a left and right surround channel, respectively, wherein each of these channel representatives $c_3$ and $c_4$ is based on the noise component weighted with a respective weighting factor $w_{nc,3}$, $w_{nc,4}$. For instance, these weighting factors may be chosen such that $w_{nc,4}=-w_{nc,5}$ hold. For instance, $w_{nc,4}=1$ and $w_{nc,5}=-1$ may hold.

As a non-limiting example, an exemplary 5.1 signal representation may be generated as follows:

$$c_1=w_{nrc,1}*nrc+w_{nc,1}*nc, \quad (12)$$

$$c_2=w_{nrc,2}*nrc+w_{nc,2}*nc, \quad (13)$$

$$c_3 = w_{nc,3} * nc, \quad (14)$$

$$c_4 = w_{nc,4} * nc, \quad (15)$$

$$c_5 = w_{nrc,5} * nrc, \text{ and} \quad (16)$$

$$c_6 = \text{low frequency representative.} \quad (17)$$

As an example, the first channel representative $c_1$ and the second channel representative $c_2$ may be associated with a left and right channel, respectively, wherein each of these channel representatives $c_1$ and $c_2$ may be based on a combination of the noise reduced component and the noise component in accordance with a respective first or second combination rule. For instance, in accordance with the first combination rule associated with the first channel representative, the weighting factor $w_{nrc,1}$ may be $w_{nrc,1}=1$ and in accordance with the second combination rule associated with the second channel representative, the weighting factor $w_{nrc,2}$ may be $w_{nrc,2}=1$. Furthermore, in accordance with the first and second combination rule, $w_{nc,1}=-w_{nc,2}$ may hold. Thus, an addition of the second and third channel representative results in a noise reduced mono output since the weighted noise components $w_{nc,1}$*nc and $w_{nc,2}$*nc are configured to eliminate each other when being summed up. For instance, $w_{nc,1}=1$ and $w_{nc,2}=-1$ may hold.

Furthermore, as an example, the third channel representative $c_3$ and the fourth channel representative $c_4$ may be associated with a left and right surround channel, respectively, as mentioned above.

The fifth channel representative $c_5$ may be associated with a middle channel generated based on the noise reduced component (or, alternatively based on the original signal), wherein the respective weighting factor may be set to an appropriate value, e.g. $w_{nrc,5}=1$ may hold.

The sixth channel representative $c_6$ may be the above-mentioned further channel representative.

Accordingly, it may be possible to generate a spatial signal representation comprising a plurality of channel representatives based on the noise reduced component and based on the noise component in accordance with combination rules, wherein said combination rules may be considered to represent a signal processing matrix.

Thus, for instance, it is possible to generate this spatial signal representation based on a single mono signal, wherein the noise reduced component and the noise component of the mono signal are used for generating this spatial signal.

According to an exemplary embodiment of all aspects of the invention, the sum of the at least two channel representations comprises no noise component.

Thus, for instance, the weighting factors $w_{nc,i}$ associated with all channel representations comprising a weighted noise reduced component may be chosen in such a way that the sum of these weighting factors $w_{nc,1}$ is zero. As an example, in this case the summed up output signal might be mono compatible.

According to an exemplary embodiment of all aspects of the invention, the sum of the at least two channel representations represent the noise reduce component.

This may be achieved by an appropriate setting of the respective weighting factors. For instance, this may holds in case the signal representation is a surround representation.

According to an exemplary embodiment of all aspects of the invention, the noise component and the noise reduced component represent at least partially decorrelated components.

According to an exemplary embodiment of all aspects of the invention, the noise component basically comprises background noise of the signal.

For instance, the noise component may represent a background noise which may have been recorded by the signal source, e.g. the single one microphone or the single one video camera.

This background noise may represent a kind of spatial noise information of the original signal which may be separated from the main information of the original signal.

According to an exemplary embodiment of all aspects of the invention, the signal is one of an audio signal, speech signal and video signal.

According to an exemplary embodiment of all aspects of the invention, the embodiment forms part of a Third Generation Partnership Project speech and/or audio codec, in particular an Enhanced Voice Service codec.

According to a further aspect of the invention, a system id disclosed, comprising a noise processing entity and a signal processing entity, wherein the noise processing entity is configured to generate a noise reduced component of a signal and a noise component of a, wherein the signal may represent the original signal mentioned above.

Furthermore, the system comprises the signal processing entity which is configured to generate a signal representation comprising at least two channel representatives based on the noise reduced component and the noise component according to all aspects of the inventions mentioned above.

For instance, both the noise processing entity as well as the signal processing entity may be implemented in a same entity.

The noise processing entity may be fed with the original signal and, for instance, may be configured to separate the noise reduced component from noise component of the signal.

For instance, a subband based narrow-, wide-, superwide-, or fullband noise suppressor may be used to extract the noise reduced component from the signal, but, as an example, any other well suited noise suppressor algorithm may be used, like a Wiener filter, Kalman filter, subspace filter, transform domain, spectral subtraction, RLS, MLS or any other adaptive or non-adative linear or non-linear filter based approaches.

Other features of all aspects of the invention will be apparent from and elucidated with reference to the detailed description of embodiments of the invention presented hereinafter in conjunction with the accompanying drawings. It is to be understood, however, that the drawings are designed solely for purposes of illustration and not as a definition of the limits of the invention, for which reference should be made to the appended claims. It should further be understood that the drawings are not drawn to scale and that they are merely intended to conceptually illustrate the structures and procedures described therein. In particular, presence of features in the drawings should not be considered to render these features mandatory for the invention.

DETAILED DESCRIPTION OF EMBODIMENTS OF THE INVENTION

Figure 1A:
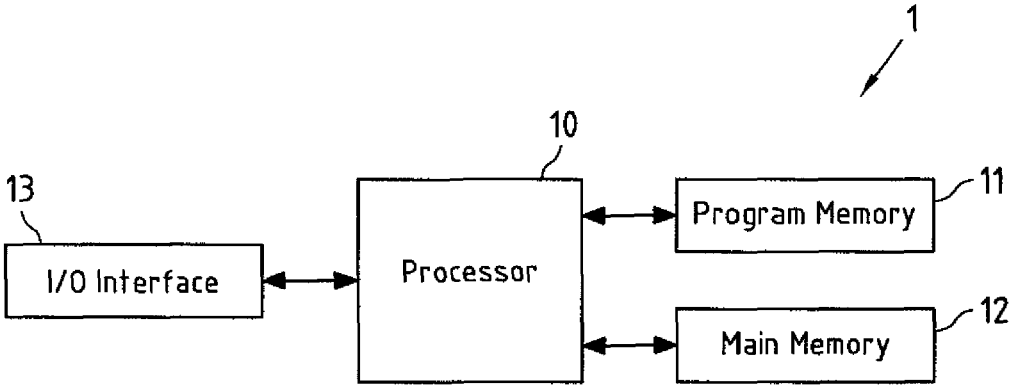
FIG. 1*a*: A schematic illustration of an apparatus according to an embodiment of the invention.

FIG. 1 schematically illustrates components of an apparatus 1 according to an embodiment of the invention. Apparatus 1 may for instance be an electronic device that is for instance capable of encoding at least one of speech, audio and video signals, or a component of such a device. Apparatus 1 is in particular configured to identify one or more target vectors from a plurality of candidate vectors. Apparatus 1 may for instance be embodied as a module. Non-limiting examples of apparatus 1 are a mobile phone, a personal digital assistant, a portable multimedia (audio and/or video) player, and a computer (e.g. a laptop or desktop computer).

Apparatus 1 comprises a processor 10, which may for instance be embodied as a microprocessor, Digital Signal Processor (DSP) or Application Specific Integrated Circuit (ASIC), to name but a few non-limiting examples. Processor 10 executes a program code stored in program memory 11, and uses main memory 12 as a working memory, for instance to at least temporarily store intermediate results, but also to store for instance pre-defined and/or pre-computed databases. Some or all of memories 11 and 12 may also be included into processor 10. Memories 11 and/or 12 may for instance be embodied as Read-Only Memory (ROM), Random Access Memory (RAM), to name but a few non-limiting examples. One of or both of memories 11 and 12 may be fixedly connected to processor 10 or removable from processor 10, for instance in the form of a memory card or stick.

Processor 10 further controls an input/output (I/O) interface 13, via which processor receives or provides information to other functional units.

As will be described below, processor 10 is at least capable to execute program code for identifying one or more target vectors from a plurality of candidate vectors. However, processor 10 may of course possess further capabilities. For instance, processor 10 may be capable of at least one of speech, audio and video processing, for instance based on sampled input values. Processor 10 may additionally or alternatively be capable of controlling operation of a portable communication and/or multimedia device.

Apparatus 1 of FIG. 1 may further comprise components such as a user interface, for instance to allow a user of apparatus 1 to interact with processor 10, or an antenna with associated radio frequency (RF) circuitry to enable apparatus 1 to perform wireless communication.

The circuitry formed by the components of apparatus 1 may be implemented in hardware alone, partially in hardware and in software, or in software only, as further described at the end of this specification.

Figure 1B:
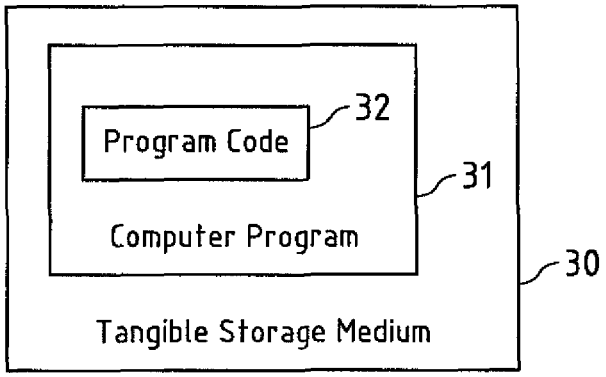
FIG. 1*b*: a tangible storage medium according to an embodiment of the invention.
Figure 2:
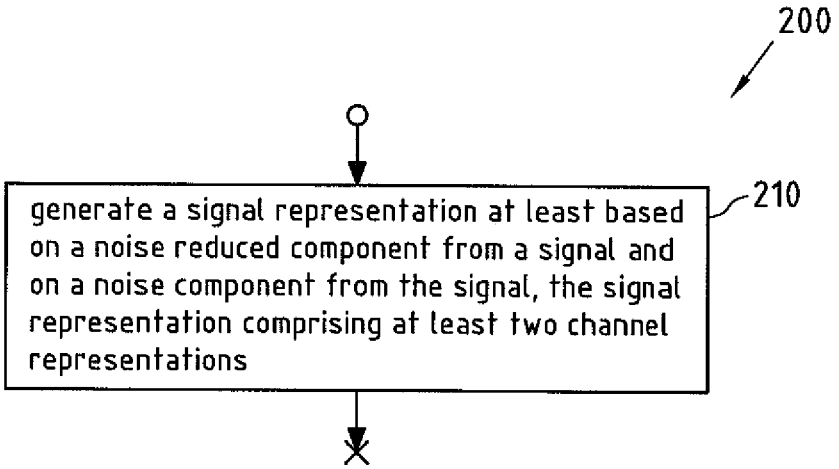
FIG. 2: a flowchart of a method according to a first embodiment of the invention.
Figure 3:
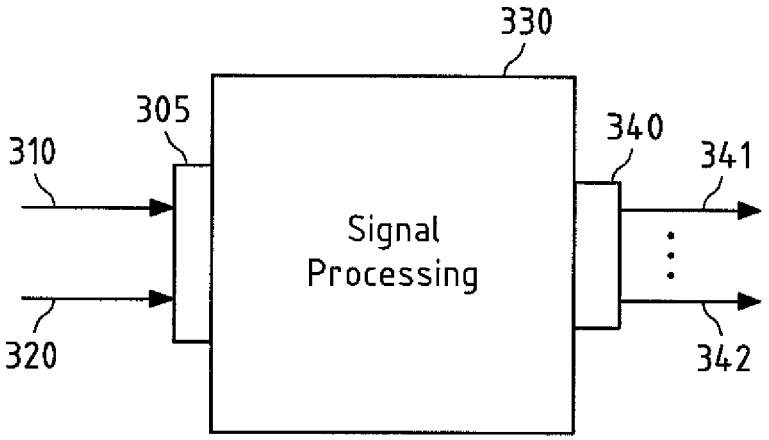
FIG. 3: a schematic illustration of an apparatus according to a second embodiment of the invention.

FIG. 2 shows a flowchart 200 of a method according to an embodiment of the invention. The steps of this flowchart 200 may for instance be defined by respective program code 32 of a computer program 31 that is stored on a tangible storage medium 30, as shown in FIG. 1*b*. Tangible storage medium 30 may for instance embody program memory 11 of FIG. 1, and the computer program 31 may then be executed by processor 10 of FIG. 1. The method 200 depicted in FIG. 2 will be explained in conjunction with the apparatus 300 according to a second embodiment of the invention depicted in FIG. 3. The apparatus 300 comprises a signal processing entity 330 which is configured to perform the method 200 depicted in FIG. 2.

Returning to FIG. 2, in a step 210 a signal representation is generated at least based on a noise reduced component 310 from a signal and on a noise component 320 from the signal, said signal representation comprising at least two channel representations 341, 342. The signal may be denoted as original signal in the sequel. For instance, the signal processing entity 330 may comprise an output 340 configured to output the at least two channel representations 341, 342 and may comprise an input 305 configured to receive the noise reduced component 310 and the noise signal 320. Furthermore, as an example, the input 305 might be configured to receive the original signal.

For instance, said original signal may represent a speech, audio or video signal. Furthermore, as an example, said original signal may represent a mono signal which may be generated by a single signal source configured to record/or capture an audio or video signal from the environment, e.g. like a single (mono) microphone or a single (mono) video camera or any other well-suited single signal source.

As an example, the signal representation comprising said at least two channel representations 341, 342 may represent a kind of spatial signal representation. As an example, said spatial signal representation may be a kind of stereo, binaural stereo or another multi-channel playback signal representation, wherein said at least two channel representations 341, 342 may form said spatial signal representation.

For instance, at least two of the at least two channel representations 341, 342 may differ at least partially from each other and/or at least two of the at least two channel representations 341, 342 may be substantially the same or may be equal.

As depicted in step 210 in FIG. 2, said at least two channel representations are generated based on a noise reduced component 310 from the original signal and on a noise component 320 from the original signal.

The noise reduced component 310 may be a component representing the main information content of the signal and the noise component 320 may be a component representing at least partially the noise of the signal. As an example, the noise component and the noise reduced component may represent at least partially decorrelated components. For instance, the noise component 320 may be considered to represent a separate channel containing mainly spatial signal field.

For instance, the noise component 320 may represent a background noise which may have been recorded by the signal source. The noise reduced component 320 may for instance at least mostly represent the main information component of the signal. For instance, under the non-limiting example that the signal represents a speech signal, the main information may represent the speech information in the signal and the noise component 320 may represent a background noise in the signal.

Figure 4:
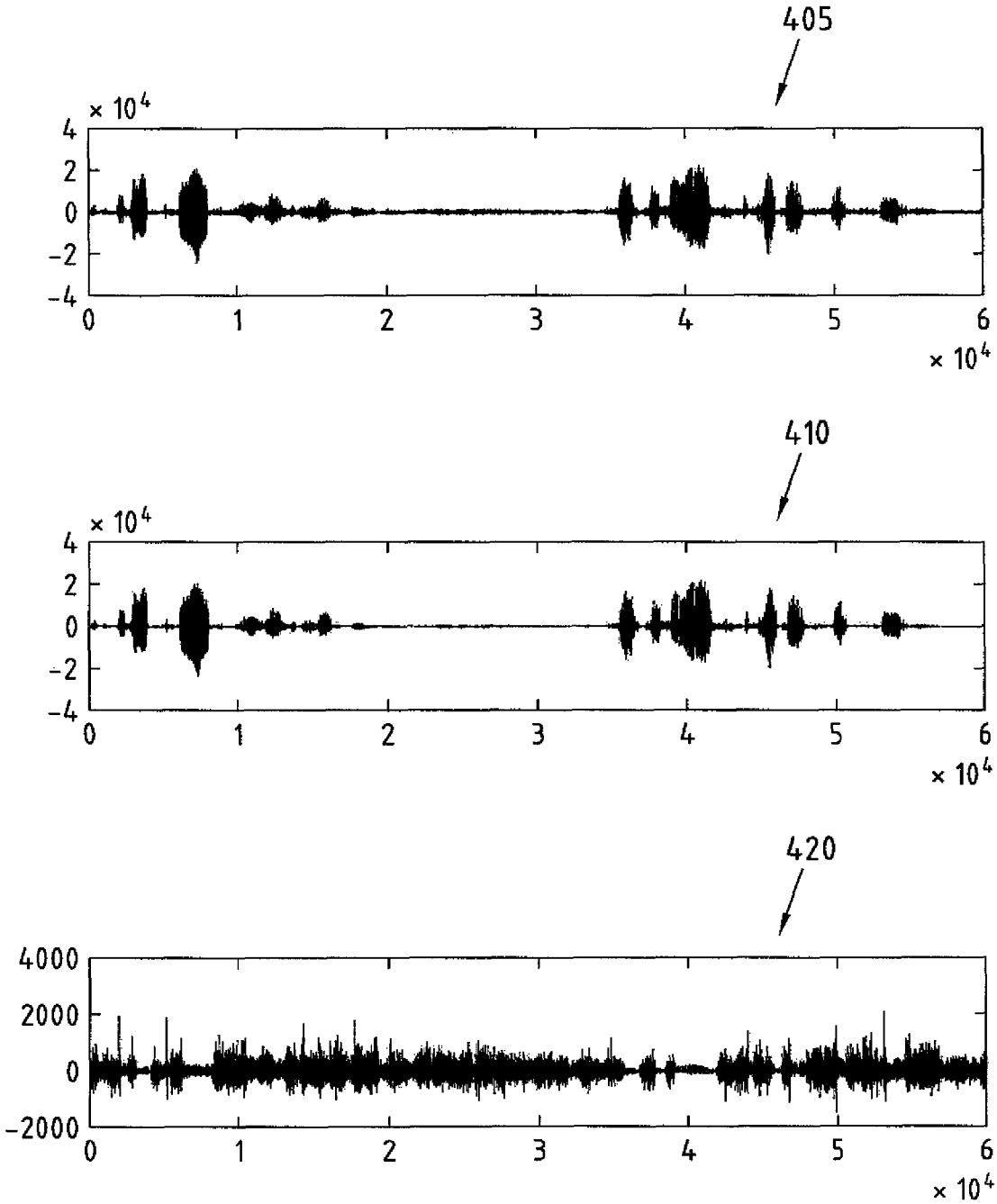
FIG. 4: an illustration of an exemplary signal, a noise reduced component of this signal and a noise component of this signal.

FIG. 4 shows an illustration of an exemplary an signal 405, a noise reduced component 410 of this signal 405 and a noise component 420 of this signal 405.

As an example, a noise processing entity may be fed with the signal 405 and may be configured to separate the noise reduced component 310, 410 from noise component 320, 420 of the signal 405.

The noise component 320 may be considered to represent a spatial signal information which can be used for generating said signal representation comprising said at least two channel representations in accordance with step 210. For instance, if the noise component 320 mainly comprises the background noise, this background noise may represent a kind of spatial noise information of the signal which is separated from the main information.

For instance, the noise component 320 may be at least partially combined with the noise reduce component 310 and/or at least partially combined with the original signal in order to generate at least one channel representative of the at least two channel representatives in accordance with a respective combination rule.

The combining may comprise any suited mathematical function, for instance at least one of addition, subtraction, filtering, mixing or weighting.

Thus, as an example, generating the signal representation comprising said at least two channel representatives based on the noise reduced component 310 and on the noise component 320 can be performed in such a way that the noise component 320 may be used to introduce a spatial effect on the at least two channel representatives by means of combining the noise component 320 with the noise reduced component 320 and/or the original signal in accordance with a combination rule in order to obtain at least one of the at least two channel representatives. For instance, this combination rule may be part or may represent a signal matrix processing rule.

Accordingly, the noise reduced component 310, the noise component 320 and (optionally) the original signal may be combined to produce a spatial signal representation in accordance with a combination rule, wherein said combining may comprise any suited mathematical function, for instance at least one of addition, subtraction, filtering, mixing or weighting, as mentioned above.

For instance, at least one of the at least two channel representations 341, 342 is generated based on a combination of the noise reduced component 310 and the noise component 320 in accordance with a combination rule.

For instance, as a non-limiting example, said combination rule for generating an ith channel representation $c_i$ may combine the noise reduced component 310, denoted as nrc and the noise component 320, denoted as nc in the following way:

$$c_i=w_{nrc,i}*nrc+w_{nc,i}*nc, \tag{18}$$

wherein $w_{nrc,i}$ and/or $w_{nc,i}$ may represent optional weighting factors.

As an example, in case said signal representation represents a stereo signal representation, wherein said at least two channel representations 341, 342 comprises a first channel representation 341 associated with a left channel and a second channel representation 342 associated with a right channel, the first channel representation 341 may be generated based on a combination of the noise reduced component 310 and the noise component 320 in accordance with a first combination rule and the second channel representation 341 may be generated based on a combination of the noise reduced component 310 and the noise component 320 in accordance with a second combination rule, wherein the first and second combination rule differ from each other at least partially.

For instance, as an example of the first combination rule, the noise component 320, denoted as nc, may be added to the noise reduced component 310, denoted as nrc, in order to generate the first channel representative 341, denoted as $c_1$, which may be expressed as follows:

$$c_1=w_{nrc,1}*nrc+nc. \tag{19}$$

Furthermore, for instance, as an example of the second combination rule, the noise component 320 may be subtracted from the noise reduced component 310 in order to generate the second channel representative 342, denoted as $c_2$, which may be expressed as follows:

$$c_2=w_{nrc,2}*nrc-nc. \tag{20}$$

For instance, the optional weighting factors $w_{nrc,1}$ and/or $w_{nrc,1}$ may be used to shift the main information to a desired channel of the left of right channel by means of setting the optional weighting factor associated with the desired channel to a higher value than the weighting factor associated with the other channel.

As an example, the weighting factor $w_{nrc,1}$ may be set to $w_{nrc,1}=1$ and the weighting factor $w_{nrc,2}$ may be set to $w_{nrc,2}>w_{nrc,1}$ e.g. to $w_{nrc,2}=1.5$, wherein this may result that the main information is slightly panned to the right channel with background coming from an ambivalent direction.

Furthermore, there may be additional weighting factor(s) $w_{nc,i}$ in order to weight the noise component 320 (denoted as nc) in accordance with the first and/or second combination rule.

As another example, at least one of the at least two channel representations 341, 342 is generated based on a combination of the noise reduced component 310, the noise component 320 and the original signal in accordance with a combination rule.

For instance, as a non-limiting example, said combination rule for generating an ith channel representation may combine the noise reduced component 310, denoted as nrc, the noise component 320, denoted as nc, and the original signal, denoted as s to channel representation c in the following way:

$$c_i=w_{nrc,i}*nrc+w_{nc,i}*nc+w_{s,i}*s, \tag{21}$$

wherein $w_{nrc,i}$, $w_{nc,i}$ and/or $w_{s,i}$ may represent optional weighting factors.

As an example, this combination rule may be used as a basis for generating a binaural signal representation comprising a first channel representation $c_1$ associated with a left channel and comprising a second channel representation associated with a right channel $c_2$, which may be expressed as follows:

$$c_1=w_{nrc,1}*nrc+w_{nc,1}*nc+w_{s,1}*s, \text{ and} \tag{22}$$

$$c_2=w_{nrc,2}*nrc+w_{nc,2}*nc+w_{s,2}*s. \tag{23}$$

For instance, the weighting factors might be chosen that $c_1=c_2$ holds. In this example, a summed up output signal may be a mono representation. As a non-limiting example, $w_{nrc,1}=w_{nc,1}=w_{nc,2}=w_{nrc,1}=1$ may hold, and $w_{s,1}=w_{s,2}<1$ may hold, wherein $w_{s,1}=w_{s,2}=0.5$ may hold. Thus, the main information can be positioned in the middle and the background noise may come from a middle direction.

As another example, the weighting factors might be chosen that c1 and c2 differ from each other. For instance, if it is desired that the background noise shall come from an ambivalent direction, the weighting factors $w_{nc,1}$, and $w_{nc,2}$ may differ from each other, e.g. $w_{nc,1}=-w_{nc,2}$ may hold. For instance, $w_{nc,1}=1$ and $w_{nc,2}=-1$ (or vice versa) may hold.

The weighting factors may be chosen different from this example in order to obtain another well-suited adjustment of the main information and the background noise. For instance, the weighting factors may be chosen that the main information is shifted to a desired channel of the left or right channel.

As another example, at least one of the at least two channel representations 341, 342 is a representation of the noise component 320. For instance, an ith channel representation may be represented by the noise component 320, denoted as nc, weighted with a respective weighting factor:

$$c_i = w_{nc,i} * nc. \tag{24}$$

As another example, at least one of the at least two channel representations 341, 342 is a representation of the noise reduced component 310. For instance, an ith channel representation may be represented by the noise reduced component 310, denoted as nrc, weighted with a respective weighting factor:

$$c_i = w_{nrc,i} * nrc. \tag{25}$$

As another example, at least one of the at least two channel representations 341, 342 is a representation of the original signal. For instance, an ith channel representation may be represented by the original signal, denoted as s, weighted with a respective weighting factor:

$$c_i = w_{s,i} * s; \tag{26}$$

For instance, said at least two channel representations may represent at least three channel representations, wherein a first channel representation may be associated with a left channel, a second channel representation may be associated with a right channel and a third channel representation may be associated with a middle channel. Thus, said signal representation may be a surround signal representation.

As an example, the middle channel may be a representation of the noise reduced component or may be a representation of the original signal.

Furthermore, for instance, the first channel representation may be generated based on a combination of the noise reduced component 310, the noise component 320 and the original signal in accordance with a first combination rule or based on a combination of the noise the noise reduced component 310 and the noise component 320 in accordance with a first combination rule, as mentioned above, and for instance, the second channel representation may be generated based on a combination of the noise reduced component 310, the noise component 320 and the original signal in accordance with a first combination rule or based on a combination of the noise the noise reduced component 310 and the noise component 320 in accordance with a second combination rule, as mentioned above.

Furthermore, a further channel representation may be low-frequency representation generated based on a high pass filtered original signal 405 or on a high pass filtered noise reduced signal 310, wherein, as an example, this a low frequency representative may be a bass signal representative which might used for a subwoofer or any other bass loadspeaker.

For instance, said surround signal representation may be a 3.1, 5.1, 7.1, 9.1 or any other surround signal representation, wherein the "1" in the x.i representation may be represented by the further channel representation and x may represent an odd number of channel representations.

As a non-limiting example, an exemplary 5.1 signal representation may be generated as follows:

$$c_1 = w_{nrc,1} * nrc, \tag{27}$$

$$c_2 = w_{nrc,2} * nrc + w_{nc,2} * nc, \tag{28}$$

$$c_3 = w_{nrc,3} * nrc + w_{nc,3} * nc, \tag{29}$$

$$c_4 = w_{nc,4} * nc, \tag{30}$$

$$c_5 = w_{nc,5} * nc, \text{ and} \tag{31}$$

$$c_6 = \text{low frequency representative.} \tag{32}$$

Thus, the first channel representative $c_1$ may be associated with a middle channel generated based on the noise reduced component 310, wherein the respective weighting factor may be set to an appropriate value, e.g. $w_{nrc,1}=1$ may hold.

As an example, the second channel representative $c_2$ and the third channel representative $c_3$ may be associated with a left and right channel, respectively, wherein each of these channel representatives $c_2$ and $c_3$ is based on a combination of the noise reduced component 310 and the noise component 320 in accordance with a respective second or third combination rule. For instance, in accordance with the second combination rule associated with the second channel representative, the weighting factor $w_{nrc,2}$ may be $w_{nrc,2}=1$ and in accordance with the third combination rule associated with the third channel representative, the weighting factor $w_{nrc,3}$ may be $w_{nrc,3}=1$. Furthermore, in accordance with the second and third combination rule, $w_{nc,2}=-w_{nc,3}$ may hold. Thus, an addition of the second and third channel representative results in a noise reduced mono output since the weighted noise components $w_{nc,2}$*nc and $w_{nc,3}$*nc are configured to eliminate each other when being summed up. For instance, $w_{nc,2}=1$ and $w_{nc,3}=-1$ may hold. This would provide enhanced mono compatibility in case of surround downmixing.

Furthermore, as an example, the fourth channel representative $c_4$ and the fifth channel representative $c_5$ may be associated with a left and right surround channel, respectively, wherein each of these channel representatives $c_4$ and $c_5$ is based on the noise component 320 weighted with a respective weighting factor $w_{nc,4}$, $w_{nc,5}$. For instance, these weighting factors may be chosen such that $w_{nc,4}=-w_{nc,5}$ hold. For instance, $w_{nc,4}=1$ and $w_{nc,5}=-1$ may hold. This would provide enhanced compatibility in case of surround downmixing.

The sixth channel representative may be the above-mentioned further channel representative.

Accordingly, it may be possible to generate a spatial signal representation comprising a plurality of channel representatives based on the noise reduced component 310 and based on the noise component 320 in accordance with combination rules, wherein said combination rules may be considered to represent a signal processing matrix.

Thus, for instance, it is possible to generate this spatial signal representation based on a single mono signal, wherein the noise reduced component 310 and the noise component 320 of the mono signal are used for generating this spatial signal.

Figure 5:
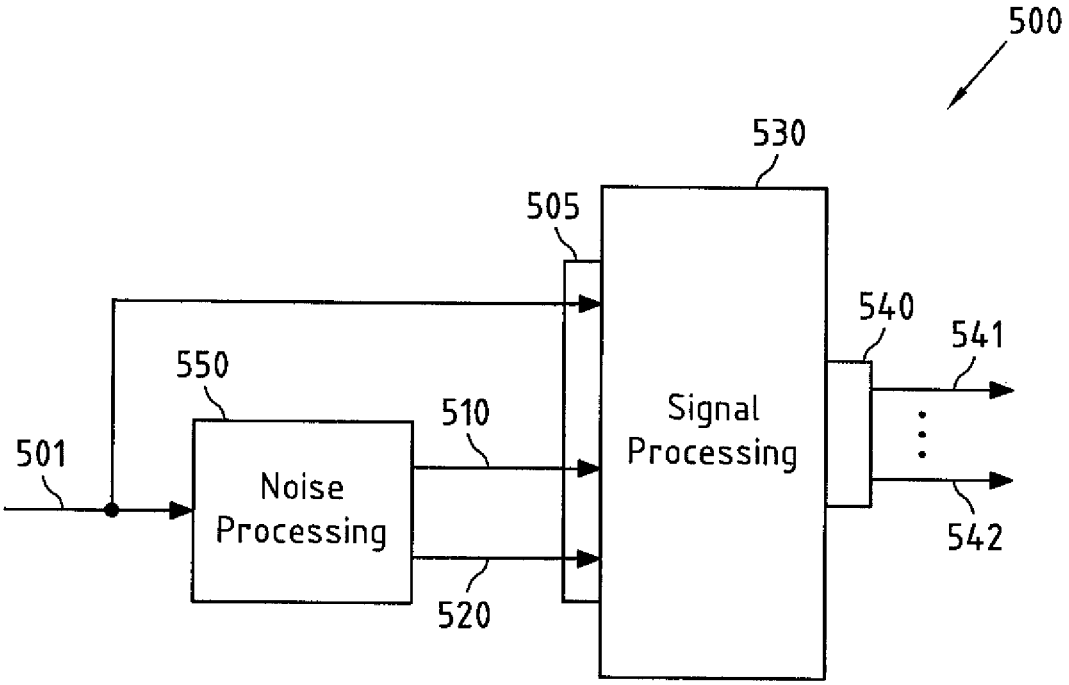
FIG. 5: a schematic illustration of a system according to an embodiment of the invention.

FIG. 5 depicts a schematic illustration of a system 500 according to an embodiment of the invention.

This system comprises a noise processing entity 550 and a signal processing entity 530, wherein the noise processing entity 550 is configured to generate a noise reduced component 510 of a signal 501 and a noise component 520 of the signal 501, wherein the signal 501 may represent the original signal mentioned above. Thus, any explanations given above with respect to the noise reduced component 310 and the noise component 320 may also hold for the noise reduced component 510 and the noise component 520.

Furthermore, the system comprises the signal processing entity 530 which is configured to generate a signal representation comprising at least two channel representatives 541, 542 based on the noise reduced component 510 and the noise component 520, wherein this signal processing entity 530 may be based or correspond on the signal processing entity 330 mentioned above. Thus, any explanations given above with respect to generating the at least two channel representatives 341, 345 also hold for generating the at least two channel representatives 541, 542, wherein input 505 may correspond to input 305 and output 540 may correspond to output 540.

For instance, both the noise processing entity 550 as well as the signal processing entity 530 may be implemented in a same entity.

As used in this application, the term 'circuitry' refers to all of the following:

(a) hardware-only circuit implementations (such as implementations in only analog and/or digital circuitry) and (b) combinations of circuits and software (and/or firmware), such as (as applicable):

(i) to a combination of processor(s) or (ii) to portions of processor(s)/software (including digital signal processor(s)), software, and memory(ies) that work together to cause an apparatus, such as a mobile phone or a positioning device, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a mobile terminal.

With respect to the aspects of the invention and their embodiments described in this application, it is understood that a disclosure of any action or step shall be understood as a disclosure of a corresponding (functional) configuration of a corresponding apparatus (for instance a configuration of the computer program code and/or the processor and/or some other means of the corresponding apparatus), of a corresponding computer program code defined to cause such an action or step when executed and/or of a corresponding (functional) configuration of a system (or parts thereof).

The aspects of the invention and their embodiments presented in this application and also their single features shall also be understood to be disclosed in all possible combinations with each other. It should also be understood that the sequence of method steps in the flowcharts presented above is not mandatory, also alternative sequences may be possible.

The invention has been described above by non-limiting examples. In particular, it should be noted that there are alternative ways and variations which are obvious to a skilled person in the art and can be implemented without deviating from the scope and spirit of the appended claims.

The invention claimed is:

1. A method performed by an apparatus, said method comprising:

generating a signal representation at least based on a noise reduced component from a signal and on a noise component from the signal, said signal representation comprising at least two channel representations, wherein generating the signal comprises generating the signal representation based on a first combination rule associated with a first weighting factor representing the noise reduced component and a second combination rule associated with a second weighting factor representing the noise component.

2. The method according to claim 1, wherein the signal represents a mono signal.

3. The method according to claim 1, wherein said signal representation is a spatial signal representation.

4. The method according to claim 1, wherein at least one of the at least two channel representations is a representation of the noise reduced component.

5. The method according to claim 1, wherein at least one of the at least two channel representations is a representation of the noise component.

6. The method according to claim 1, wherein at least one of the at least two channel representations is based on a combination of the noise reduced component, the noise component and the signal in accordance with a combination rule.

7. The method according to claim 1, wherein at least one of the at least two channel representations is generated based on a combination of the noise reduced component and the noise component in accordance with a combination rule.

8. The method according to claim 7, wherein the signal representation comprises first channel representation based on a combination of the noise reduced component and the noise component in accordance with a first combination rule and a second channel representation based on a combination of the noise reduced component and the noise component in accordance with a second combination rule.

9. The method according to claim 8, wherein the signal representation comprises a third channel representation being a first representation of the noise component and a fourth channel representation being a second representation of the noise component.

10. The method according to claim 1, wherein the noise component and the noise reduced component represent at least partially decorrelated components.

11. The method according to claim 1, wherein the noise component basically comprises background noise of the signal.

12. The method according to claim 1, wherein the signal is one of an audio signal, speech signal and video signal.

13. The method according to claim 1, wherein said method forms part of a Third Generation Partnership Project speech and/or audio codec, in particular an Enhanced Voice Service codec.

14. A computer program product comprising a least one computer readable non-transitory memory medium having program code stored thereon, the program code which when executed by an apparatus cause the apparatus at least to generate a signal representation at least based on a noise reduced component from a signal and on a noise component from the signal, said signal representation comprising at least two channel representations, wherein generating the signal comprises generating the signal representation based on a first combination rule associated with a first weighting factor representing the noise reduced component and a second combination rule associated with a second weighting factor representing the noise component.

15. An apparatus, comprising at least one processor; and at least one memory including computer program code for one or more programs, said at least one memory and said computer program code configured to, with said at least one processor, cause said apparatus at least to perform the following:

generate a signal representation at least based on a noise reduced component from a signal and on a noise component from the signal, said signal representation comprising at least two channel representations, wherein generating the signal comprises generating the signal representation based on a first combination rule associated with a first weighting factor representing the noise reduced component and a second combination rule associated with a second weighting factor representing the noise component.

16. The apparatus according to claim 15, wherein the signal represents a mono signal and said signal representation is a spatial signal representation.

17. The apparatus according to claim 15, wherein at least one of the at least two channel representations is a representation of the noise reduced component.

18. The apparatus according to claim 15, wherein at least one of the at least two channel representations is a representation of the noise component.

19. The apparatus according to claim 15, wherein at least one of the at least two channel representations is based on a combination of the noise reduced component, the noise component and the signal in accordance with a combination rule.

20. The apparatus according to claim 15, wherein at least one of the at least two channel representations is generated based on a combination of the noise reduced component and the noise component in accordance with a combination rule.

* * * * *